United States Patent [19]

Buchheit

[11] Patent Number: 4,484,465

[45] Date of Patent: Nov. 27, 1984

[54] BRAKING DEVICE FOR AXIALLY RECEIVING AND TRANSVERSELY DISCHARGING ROLLED BARS

[75] Inventor: Otto K. Buchheit, Ingbert/Saar, Fed. Rep. of Germany

[73] Assignee: Mannesmann Aktiengesellschaft, Duesseldorf, Fed. Rep. of Germany

[21] Appl. No.: 435,647

[22] Filed: Oct. 21, 1982

[30] Foreign Application Priority Data

Oct. 28, 1981 [DE] Fed. Rep. of Germany ..... 3142698

[51] Int. Cl.[3] ..... B21B 39/20; B21D 45/04

[52] U.S. Cl. ..... 72/250; 72/426; 221/116; 414/745

[58] Field of Search ..... 72/208, 250, 426, 428, 72/201, 202; 140/140; 83/157; 414/745, 748; 221/116, 117, 263

[56] References Cited

U.S. PATENT DOCUMENTS 4,054,047 10/1977 Sclippa ..... 72/201

4,334,421 6/1982 Ostlinning et al. ..... 72/426

FOREIGN PATENT DOCUMENTS 465625 9/1928 Fed. Rep. of Germany .

2008250 2/1970 Fed. Rep. of Germany .

*Primary Examiner*—Ervin M. Combs

*Assistant Examiner*—Charles Rosenberg

*Attorney, Agent, or Firm*—Schwartz, Jeffery, Schwaab, Mack, Blumenthal & Koch

[57] ABSTRACT

The braking channel comprises a fixed channel section for each strand of bars, provided with two open-bottom chambers which are normally covered up by the sliding surfaces of a pendulum structure, the effect of which will brake the bars and let them come to rest. For bar discharge on to the cooling bed, the pendulum structure is swivelled rhythmically toward the right and left to positions in which the discharge openings reach underneath a pair of chambers. The kinematic inversion could also be applied, in which case the sliding section would be in a fixed position and the channel sections would move in pendulum fashion.

5 Claims, 9 Drawing Figures

Fig. 1
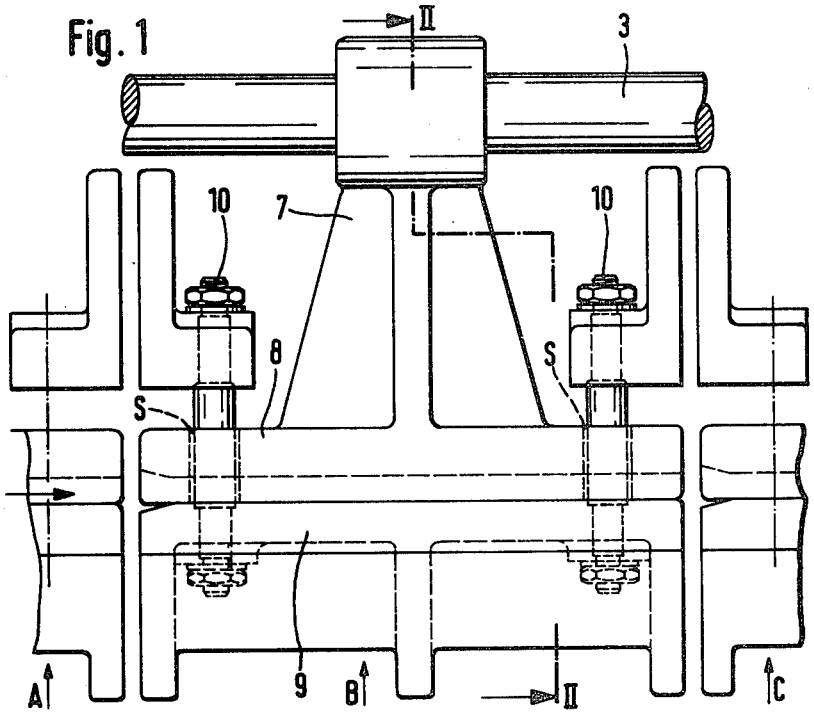
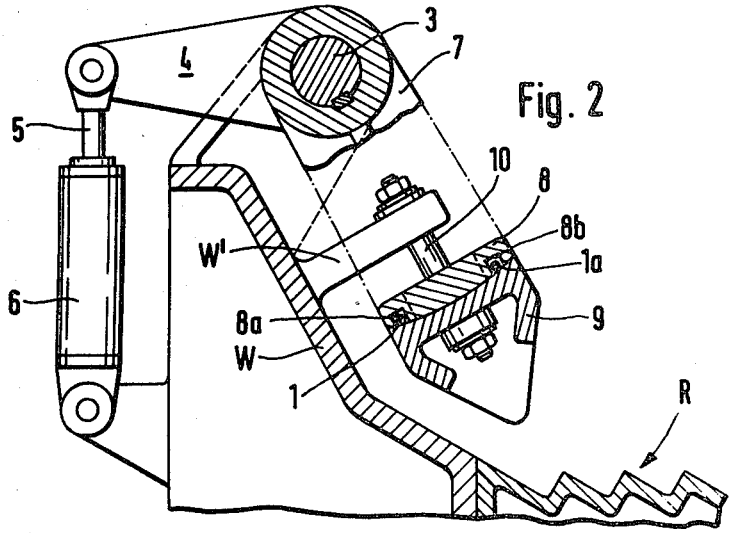
Fig. 2

Fig. 3
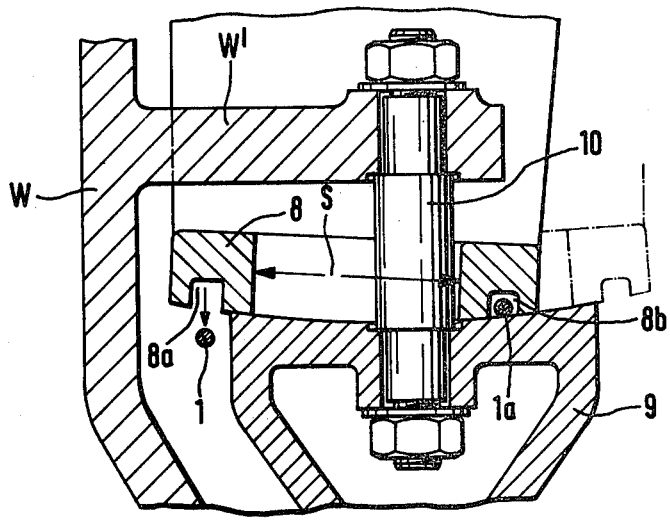
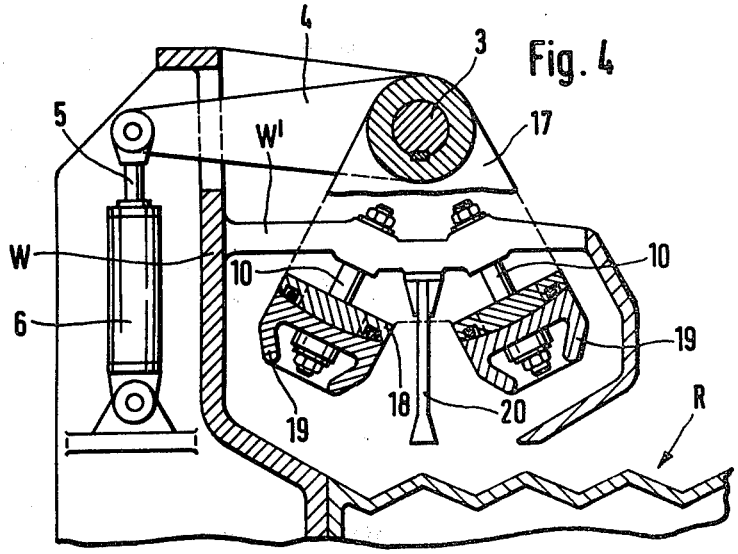
Fig. 4

BRAKING DEVICE FOR AXIALLY RECEIVING AND TRANSVERSELY DISCHARGING ROLLED BARS

The invention relates to a braking channel for rolled bars, especially for rounds, which discharge from a mill train at a high speed rate, consisting of a channel section designed to form at least two adjacent feed channels for lateral guidance of the bars, and of a sliding section forming sliding surfaces for the bars, the channel section or the sliding section being movable relative to the other fixed section in a transverse direction to the bars, such that transverse movement will let the bars present in the feed channels alternately come clear to drop down freely from the channels.

A braking channel of this type has become known by DE-A1-20 08 250 in which the channel section formed by the feed channels is in a fixed position and the sliding section is designed to form a pendulum structure which is driven to swivel reversingly about an overhead line shaft positioned in the running direction of the bars. The alternating swivel motion of the sliding surfaces in the pendulum structure, which support the bars present in the two feed channels, brings about alternate bar discharge, whereby, according to the prior art, the bars are braked step by step in multiple channels. However, the disadvantage of this braking channel construction is that the feed channels are open at their tops so that particularly small rounds may easily escape from the channels. This affects the functional reliability of the braking system.

Enclosed feed channels of a braking channel for rolled bars have become known by DE-A-465 625. The feed channels of this braking channel are provided with through longitudinal slots. By the reversing movements of the feed channels, these slots may be selectively covered up by fixed cover means. Since the tubular feed channels are controlled to rotate reversingly about their longitudinal axes, retraction of a slot from the area of the cover means will open up its respective channel and permit the bar which has come to rest in the channel to drop out freely. This known braking channel requires the use of a separately controlled rotary drive for each feed channel, contrary to the solution under DE-A1-20 08 250 which utilizes a single drive for transverse movement of the pendulum type sliding section.

Proceeding from the braking channel in DE-A1-20 08 250, the invention is based on the problem of braking the bars in enclosed feed channels, yet maintaining the advantage of using a single drive to bring about relative movement between the channel section forming the feed channels and the sliding section forming the sliding surfaces for discharge of the bars that have come to rest.

According to the invention, this problem may be solved by the use of two chambers open at their bottoms, which form the feed channels of the channel section and which are covered up by the sliding surfaces of the sliding section when the two relatively movable sections are in the center position. When the sliding surface, due to its definite length, is alternately positioned outside the vertical projection of one of the chambers by the relative transverse movement between the channel section and the sliding section, then the bar present in that chamber will be free to drop downward, advantageously into the groove of an oscillating rake type cooling bed. It will not be possible for the bars to escape during the braking procedure, since the chambers will be fully enclosed in the center position of the two relatively movable sections. Since the inventive braking channel is required to be relatively long, it should appropriately consist of a multiple of channel and sliding sections provided with entry funnels, arranged one behind the other similar to rod guiding pipe units, and with a common drive.

The invention described so far is independent of whether the channel section forming the chambers or feed channels is in a fixed position and the sliding section is transversely movable, or vice versa. However, in the preferred solution, the channel section forming the feed channels is fixed and the sliding section is transversely movable, the chambers of the channel section being separated by a web. In the center position of the sliding section, this web will cover up a discharge opening provided within the sliding surface of the sliding section and disposed to service both chambers. By transverse movement of the sliding section, the discharge opening may be alternately moved into position underneath one chamber or the other. The advantage of this solution is that the feed channels or chambers will always be in alignment with the bars as they enter the braking channel. The alternative solution in which the sliding section is in a fixed position and the channel section forming the feed channels is transversely movable and in which transverse movement of the channel section will move the chambers alternately to a position outside the sliding section, requires the use of swivel pipes for each chamber to aid the sequence of bars to be braked, these pipes being located at the entry end of the braking channel to form extensions to fixed guide pipes and being connected such that they are forced to follow the movements of the channel section or chambers.

Three exemplary embodiments of the invention will now be described, with the aid of the drawings.

FIG. 1 is a side view of a braking channel unit of a multi-unit braking channel, according to patent claim 4.

FIG. 2 is an enlarged section through line II—II in FIG. 1.

FIG. 3 is an enlarged section of FIG. 2 to illustrate bar discharge positions.

FIG. 4 is a two-strand braking channel for use in the so-called SLIT process, shown in a manner similar to FIG. 2.

Figure 5A:
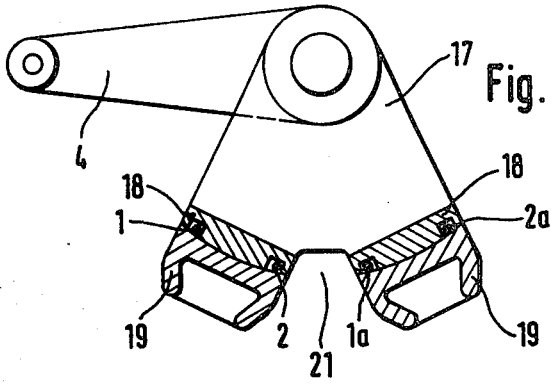
Figure 5B:
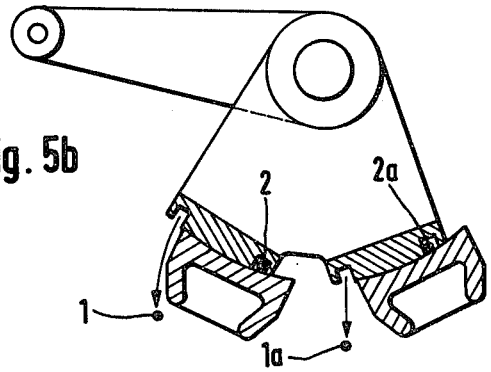
Figure 5C:
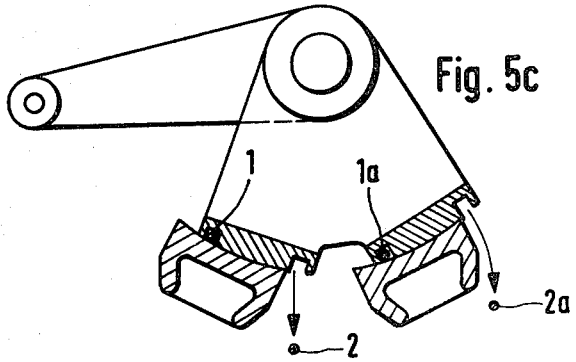

FIGS. 5*a* to 5*c* is a control scheme for operation of the two-strand braking channel in FIG. 4.

Figure 6:
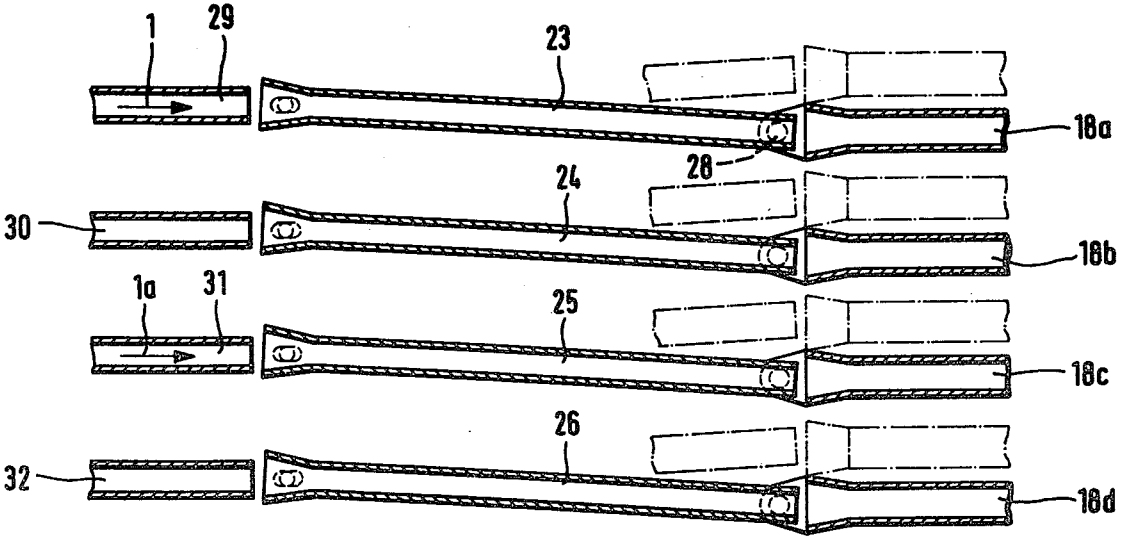

FIG. 6 shows bar feed guides for a multi-strand braking channel designed in accordance with FIG. 4.

Figure 7:
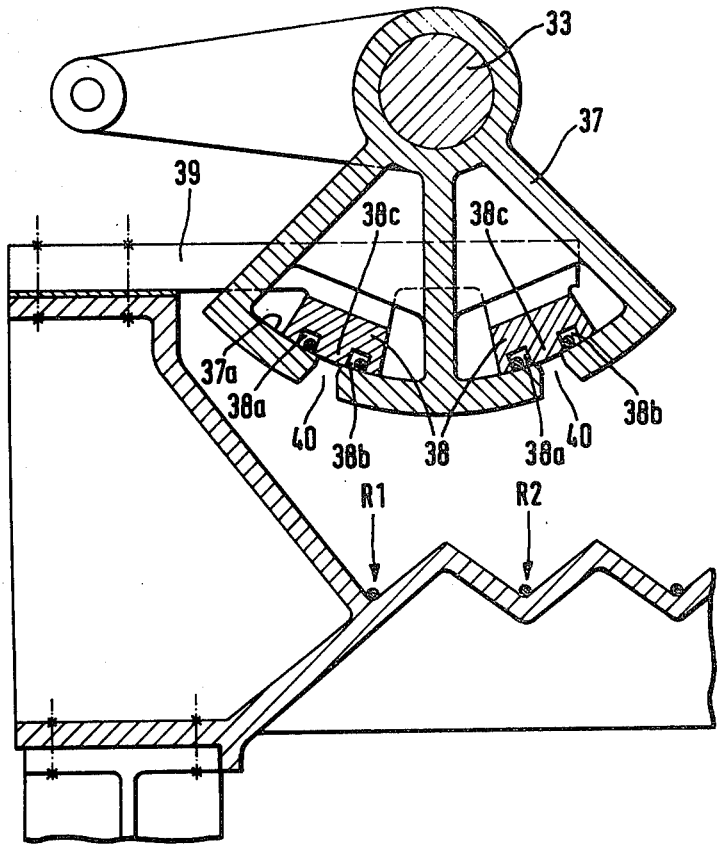

FIG. 7 is a braking channel unit as kinematic inversion of the example shown in FIGS. 1 and 2, according to the solution provided in patent claim 3.

As shown in FIG. 1, the inventive braking channel consists of a multiple of individual units A, B, C, etc. arranged in close succession. The first braking channel unit A which is shown only in part, same as unit C, is located at the entry end of the rake type cooling bed R partially shown in FIG. 2. The fixed portion of the cooling bed R has walls W sloping upward for attachment of the braking channel units. The common drive for all braking channel units includes a swivel shaft 3 extending over the entire length of the channel. At least one drive lever 4 is rotatingly connected to the shaft 3 and is actuated by the piston rod 5 of a pressurized cylinder 6.

The actual braking channel comprises a multiple of swivel levers 7 which are keyed to the swivel shaft 3 and the lower ends of which hold a channel section 8 with two open-bottom chambers 8*a* and 8*b*. In the center position of the swivel levers 7 or channel sections 8 shown in the drawing, both chambers 8*a* and 8*b* are covered up by a fixed sliding section unit 9. The sliding surface of the sliding section 9 is curved to form an arc corresponding to the circular motion of the channel section 8, i.e. the center of curvature on the sliding surface is the centerline of the swivel shaft 3. A slight amount of clearance is provided between the webs enclosing the two chambers 8*a*, 8*b* of the channel section 8 and the sliding surface of sliding section 9.

As more clearly shown in FIG. 1, the fixed sliding section 9 is held in place by hanger bars 10 located outside of each swivel lever 7. The upper ends of these bars are attached to cross-stays W' on the cooling bed walls W and reach through transverse slots S in the movable channel section 8 (FIG. 3). The purpose of these transverse slots S will be more closely explained in connection with FIG. 3.

The braking channel shown in FIGS. 1 and 2 is designed for single-strand operation in the rolling mill, i.e. the rolled bars 1 and 1*a* sheared on a rotary shear are alternately fed to the chambers 8*a* and 8*b* of the channel section 8 one after the other. The feed pipes for bars 1 and 1*a* ahead of the first channel unit A and their particular features will be described later on in connection with FIG. 6. It is assumed that bar 1 comes to rest by the braking effect of the sliding section 9 and a web section of the channel section 8, at which time the subsequent bar 1*a* will enter chamber 8*b*. For discharge of bar No. 1, a swivel motion of swivel lever 7 will move the channel section 8 clockwise into the position shown in FIG. 3. This will move chamber 8*a* to a point beyond the covering area of sliding section 9 and bar No. 1 may drop down freely against the sloping cooling bed walls W and into the first groove of the cooling bed R. Bar 1*a* in chamber 8*b* will follow this transverse movement of channel section 8 toward the left. When the swivel lever 7 and the channel section 8 return to the center position shown in FIG. 1, the next bar may enter chamber 8*a* which will now be covered up. The discharge position of channel section 8 for bar No. 1*a* is shown dash-dotted in FIG. 3. In both bar discharge positions, the transverse slots S will be in a limit position—as shown in FIG. 3 for one discharge position—in which the channel section 8 will, at most, come into contact with the hanger bars 10, so that the chambers and the bars present in these chambers will pass the hanger bars 10 at a safe distance. Thus, the minimum length of the transverse slots S is at least equal to the overall transverse shifting path of the channel section 8.

The exemplary embodiment in FIG. 4 to 6 is adaptable to the SLIT process used in rolling mills, i.e. bars are rolled 1 with 1*a* and 2 with 2*a* coherently and are separated by a longitudinal slitting cut. The example in FIG. 4 differs from FIG. 2 in that the channel section 18 is provided with four open-bottom chambers and with two fixed sliding sections 19 arranged in reverse image. These sections are separated one from the other by a free bar discharge area and, in the center position of the channel section 18 shown in FIG. 4, each will cover up a neighboring pair of chambers. In this case, of course, each sliding section 19 is provided with its own hanger bar 10. The swivel lever 17 is enlarged in width to suit the channel section 18.

The bar discharge area located between the sliding sections 19 is subdivided into two halves by vertically arranged fixed separating bars 20 to permit bars discharging into this area to feed into two neighboring grooves on the rake type cooling bed R.

The function of the inventive braking channel adaptable for use in the SLIT process may best be understood from FIG. 5*a* to 5*c*. FIG. 5*a* shows the center position of the channel section 18 in relation to the two sliding sections 19 which are spaced to provide the common bar discharge area 21. The separated bars 1 and 1*a* produced from an initial coherently rolled double bar are fed to those particular chambers of the channel section 18 which are opened up simultaneously when the channel section 18 swivels to one side, as shown in FIG. 5*b*. These bars 1 and 1*a* which enter the channel section simultaneously will come to rest simultaneously and will also drop out simultaneously. When channel section 18 is in the discharge position shown in FIG. 5*b* or in the center position shown in FIG. 5*a*, the separated bars 2 and 2*a* of the next double bar are fed into the second two chambers. These bars are discharged in the opposite discharge position (FIG. 5*c*) and the next pair of bars 1 and 1*a* may now enter the channel section.

The situation ahead of the braking channel in FIG. 4 is shown in FIG. 6. The feed channels or chambers 18*a* to 18*d* of an initial braking channel unit A (FIG. 1) are shown schematically at the right in FIG. 6, the chambers being funnel-shaped at their entry ends. Each chamber is preceded by a swivel pipe 23, 24, 25, 26. These pipes are pivotally supported at their entry ends. Their exit ends are connected to the channel section 18 by hinged bolts 28 in such a manner that each swivel pipe is forced to follow the movements of the channel section and, thus, of their associated chambers 18*a* to 18*d*. Also in FIG. 6, fixed guide pipes 29, 30, 31, 32 are provided at the entry end ahead of the swivel pipes 23 to 26 with bars 1, 1*a* of a coherently rolled double bar entering pipes 29 and 31, i.e. the pipes associated with chambers 18*a* and 18*c*. The next pair of bars of a strand are fed into guide pipes 30, 32. Swivel pipes 23 to 26 have all been swivelled from their straight center positions to a position which would come near to the situation shown in FIG. 5*c* in which chambers 18*b* and 18*d* are in their discharge positions for discharge of a previous pair of bars, whilst chambers 18*a* and 18*c* for the next bars 1, 1*a* are still covered up.

It goes without saying that the braking channel exemplified in FIG. 2 and 3 merely utilizes two swivel pipes 23, 24 and two guide pipes 29, 30.

An example of the preferred solution is shown in FIG. 7. A sliding section 37, designed to form a pendulum structure and shown in its center position, may be swivelled periodically toward the right and left about a swivel shaft 33. This exemplary embodiment is also designed for two-strand operation and is therefore provided with two feed channel sections 38, each comprising two open-bottom chambers 38*a* and 38*b* attached to fixed brackets 39 along their lengths. In the center position of the sliding section 37 shown, these chambers are covered up by the circularly curved sliding surface 37*a*, i.e. the two discharge openings 40 in the sliding section are covered up by the webs 38*c* of the channel sections 38. The function of a braking channel according to FIG. 7 essentially corresponds to that of the previous examples, except that in this case the discharge openings 40 in the sliding section 37 will alternately open up chambers 38*a* and 38*b* for discharge of the bars which have come to rest inside the chambers. The discharge openings 40 can be spaced sufficiently close, in order that simultaneously discharging bars may drop into the first two grooves R1 and R2 of the cooling bed, separately and without deflection.

What is claimed is:

1. A braking device for axially receiving and transversely discharging rolled bars discharged from a mill train at a high rate of speed comprising:

a common channel section defining at least two adjacent downwardly opening feed channels for lateral guidance of the bars;

a common sliding section cooperating with said channel section to form bottom surfaces for closing said feed channels and preventing said bars from dropping out of said feed channels; and means for swingingably moving said channel section and said sliding section relative to one another between a middle position in which both said feed channels are closed, and two laterally opposite positions in which said feed channels are opened, respectively, such that one bar at a time is allowed to drop from one feed channel at a time by moving said channel section and said sliding section relative to one another from one of said lateral positions to the other.

2. A braking device according to claim 1, including a plurality of similar channel sections and a plurality of sliding sections cooperating, respectively, with said channel sections, and including a plurality of means for swingingably moving sid channel sections and sliding sections, and a common drive means for driving each of said swingingably moving means.

3. A braking device according to claim 1 or 2, wherein said channel section is in a fixed position and said sliding section is transversely movable, and said channels of said channel section comprise chambers separated by a web, said sliding section having a discharge opening which corresponds with said web only in said relative middle position of the two sections, said discharge opening being alternately movable into positions underneath one chamber and the other by said moving means to permit bars to drop alternately from said one chamber and the other.

4. A braking channel according to claim 3, wherein said sliding section is in a fixed position and said channel section is transversely movable, said channels comprising chambers and said moving means moving said channel section such that said chambers are moved individually to opposite sides of said sliding section to allow rods to fall therefrom.

5. A braking channel according to claim 1 or 2, including fixed guide pipes for guiding rods from the mill train, and flexible guide pipes connected between said fixed guide pipes and said channels, respectively, for following movements of said channel section.

* * * * *